United States Patent [19]

Ricciardi

[11] 4,443,094

[45] Apr. 17, 1984

[54] DUPLICATING MACHINE WITH DUPLEXING CAPABILITY

[75] Inventor: Mario Ricciardi, Glenview, Ill.

[73] Assignee: AM International, Inc., Chicago, Ill.

[21] Appl. No.: 443,814

[22] Filed: Nov. 22, 1982

[51] Int. Cl.[3] ..... G03G 15/00

[52] U.S. Cl. ..... 355/3 SH; 355/14 SH; 355/3 DR; 355/23; 355/24; 101/218; 101/223; 101/230; 101/411; 271/69; 271/184; 271/225; 271/DIG. 9

[58] Field of Search ..... 355/3 SH, 14 SH, 23, 355/24, 3 DR, 3 BE; 271/DIG. 9, 225, 184, 69, 277; 101/218, 223, 230–232, 234, 246, 257, 408–411

[56] References Cited

U.S. PATENT DOCUMENTS

| | | | |
|---|---|---|---|
| 3,012,500 | 12/1961 | Koch | 101/230 |
| 3,557,391 | 11/1970 | Mowry | 101/230 X |
| 3,672,765 | 6/1972 | Altmann | 355/23 |
| 3,796,154 | 3/1974 | Weisgerber | 101/232 |
| 3,865,362 | 2/1975 | Luffy et al. | 101/410 X |
| 4,026,647 | 5/1977 | Kanno et al. | 355/3 SH |
| 4,155,545 | 5/1979 | Yanagawa et al. | 355/3 SH X |
| 4,299,473 | 11/1981 | Endo | 355/14 SH |
| 4,336,992 | 6/1982 | Szlucha et al. | 355/3 SH X |

*Primary Examiner*—A. C. Prescott

*Attorney, Agent, or Firm*—Nicholas A. Camasto; John R. Hoffman

[57] ABSTRACT

In a duplicating machine for duplicating images on both sides of copy sheets including a blanket cylinder and an impression cylinder, a mechanism for handling the sheets and re-feeding the sheets back to the impression cylinder for duplex copying. The blanket cylinder has first and second images transferable to the copy sheets. The impression cylinder forms a nip with the blanket cylinder for transferring the copy sheets through the nip. A first gripper on the impression cylinder releasably engages a lead end of a copy sheet and moves the sheet through the nip to transfer the first image on a first side of the sheet. A chain gripper releasably engages the lead end of the sheet transferred thereto by the first gripper and transports the sheet away from the impression cylinder. A swing gripper releasably engages a trail end of the sheet in timed relation with release of the sheet by the chain gripper and re-feeds the sheet back to the impression cylinder. A second gripper on the impression cylinder releasably engages the trail end of the sheet and moves the sheet through the nip to transfer the second image to a second side of the sheet.

23 Claims, 12 Drawing Figures

FIG. 3
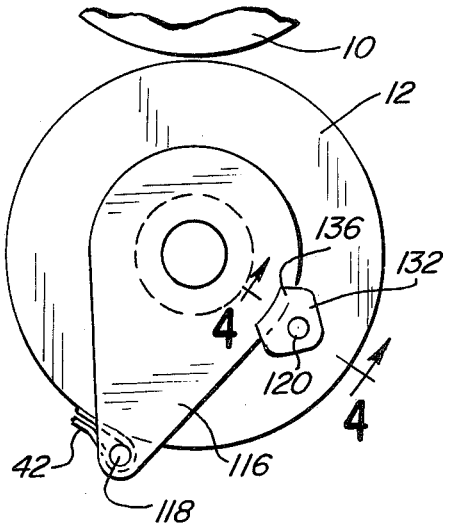
FIG. 4
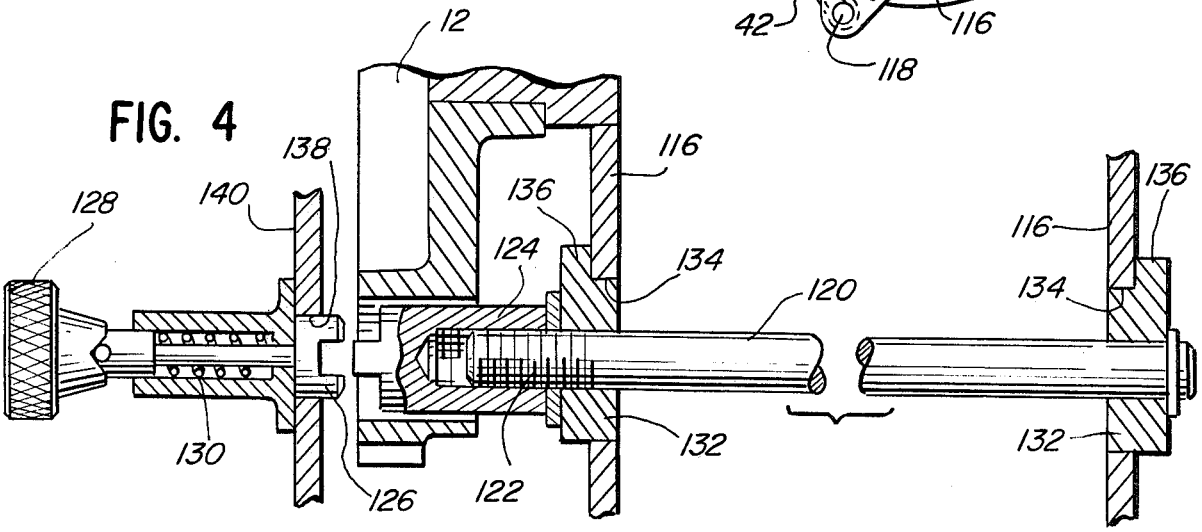
FIG. 5
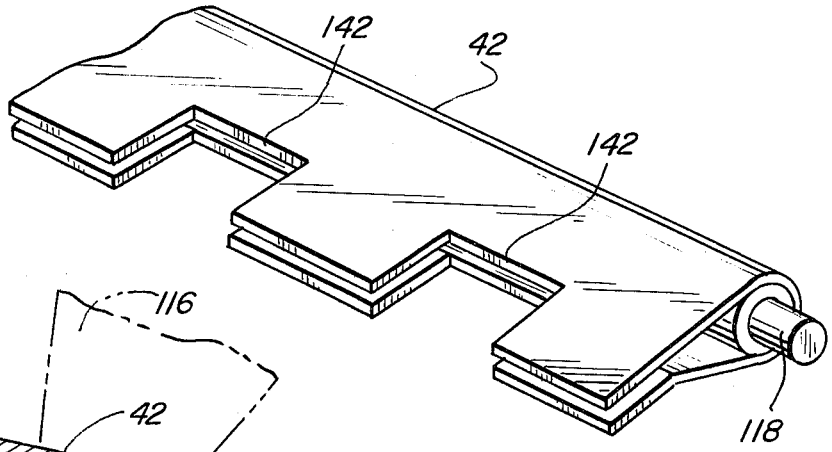
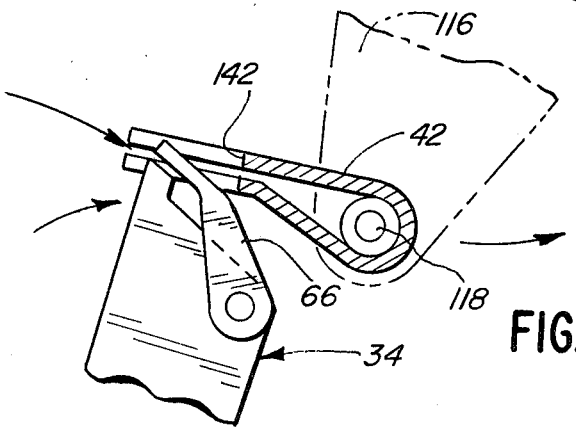
FIG. 6

DUPLICATING MACHINE WITH DUPLEXING CAPABILITY

BACKGROUND OF THE INVENTION

The present invention relates generally to a duplicating machine and, more particularly, to a machine for duplicating images on both sides of copy sheets, hereinafter sometimes referred to as "duplexing".

Duplicating machines are available for the production of copies with images formed on one side of the copy sheets. Such equipment can be reliably operated at highly satisfactory production rates. Because of the advantages of duplexing in savings of the amount of paper employed, savings in the space occupied by the copies produced, savings in production time and equipment costs, it is desirable to provide apparatus for imaging both sides of a copy sheet. It also is desirable to effect duplexing with a single printing couple to thereby provide a compact unit that may be utilized in small work areas and conserve the amount of floor space required in which to operate the equipment.

There have been various approaches in the printing and duplicating field for printing a copy sheet on a first side by a first printing couple and then on the opposite side by a second printing couple. In some instances, the printing couples are arranged in straight-line tandem. Such tandem arrangements impose certain limitations which restrict the use of the equipment to specific applications. For instance, when the printing couples are arranged in tandem, the overall size of the combined unit is extended considerably thereby requiring substantial floor space and precluding the use of the equipment in small work areas. In addition, when the units are in tandem the machine operator does not have ready access to the controls therefor to perform operations or adjustments that might be required during machine operation.

Another approach to duplex printing has been to provide a sheet handling mechanism for passing a copy sheet through a first printing couple for imaging one side of the sheet in a first direction and advancing the sheet in a second, substantially normal direction to a second printing couple. As the sheet changes direction it is inverted by a turn-over device and simultaneously directed to a second printing couple for imaging the opposite side of the sheet. Such machines are more compact than the tandem arrangements because of the L-shaped configuration of the sheet advancing paths. Such an arrangement also disposes the machine controls within easy reach of the machine operator. However, such machines still utilize two printing couples in order to effect printing of both sides of the sheet.

U.S. Pat. No. 4,241,658, issued Dec. 30, 1980 to the inventor of the present invention, shows a single printing couple for utilization in a duplexing copying system. The single printing couple includes an impression cylinder having a first gripper means adapted to engage a leading end of a copy sheet advanced thereto by appropriate sheet feeding means. The impression cylinder advances the sheet through a nip with a blanket cylinder to transfer a first image to a first side of the sheet. A second gripper means is provided on the impression cylinder, angularly spaced from the first gripper means, to releasably engage a trailing edge of a previously imaged sheet fed to the impression cylinder by a re-feeding mechanism. The formerly trailing edge of the sheet then becomes the leading edge, and the unimaged side of the sheet is exposed on the impression cylinder for receiving a second image transferred to the opposite side of the sheet by the blanket cylinder. This cycle is continuously repeated with one sheet being fed to the impression cylinder during each revolution of the cylinder, and with one duplex sheet being discharged from the cylinder for each revolution.

U.S. Pat. No. 4,186,662, issued to Borneman on Feb. 5, 1980, shows a mechanism for handling and re-feeding the sheets to an impression cylinder of the general type described above having first and second gripper means. Borneman discloses a rather complex mechanism which utilizes stripper means in conjunction with the impression cylinder for delivering sheets imaged on one side only to a reversing area. The sheets are reversed by apparatus employing multiple rollers and air streams to reverse a copy sheet at the reversing area and re-feeding the copy sheet back to the second gripper means on the impression cylinder for duplexing the opposite side of the sheet.

Although devices such as the sheet handling and reversing mechanism of Borneman offer certain advantages by employing a single printing couple for imaging both sides of a sheet, such devices require costly components within a complex system. The present invention is directed to providing a much more simple mechanism for handling copy sheets for duplexing in a duplicating machine.

SUMMARY OF THE INVENTION

An object, therefore, is to provide a new and improved device for handling copy sheets for duplexing images thereon in a duplicating machine.

Another object of the invention is to provide a sheet handling mechanism utilizing a single printing couple for imaging both sides of a copy sheet.

In the exemplary embodiment of the invention, the sheet handling mechanism is designed for use in a duplicating machine for duplicating images on both sides of copy sheets, wherein the duplicating machine includes a blanket cylinder having first and second images transferable to the copy sheets. An impression cylinder forms a nip with the blanket cylinder, and the impression cylinder supports and transfers the copy sheets through the nip. First gripper means is operatively associated with the impression cylinder for releasably engaging a lead end of a copy sheet and moving the sheet through the nip to transfer the first image to a first side of the sheet. Second gripper means is operatively associated with the impression cylinder for releasably engaging a trail end of the sheet and moving the sheet trail-end-first through the nip to transfer the second image to a second side of the sheet.

An important feature of the invention comprises means for handling the sheets and for re-feeding the sheets to the second gripper means. The handling and re-feeding means includes means for receiving a copy sheet from the first gripper means on the impression cylinder after the first image is transferred to the sheet. Swing gripper means is provided for releasably engaging the trail end of the sheet and re-feeding the sheet from the receiving means to the second gripper means on the impression cylinder.

The swing gripper means is pivotally mounted for oscillatory movement between a first position for engaging the trail end of the sheet and a second position for releasing the trail end of the sheet and re-feeding the sheet back to the impression cylinder. Actuating means is provided for pivoting the swing gripper means and, in the preferred embodiment, the actuating means is cam operated. In particular, cam follower means is operatively associated with the swing gripper means. Rotatable cam means is provided for engaging the cam follower means and pivoting the swing gripper means between the aforesaid first and second positions.

The swing gripper means includes gripper finger means which also is cam operated for moving the gripper finger means between open and closed positions for releasably engaging the trail end of the sheet. A cam follower is operatively associated with the gripper finger means. Rotatable cam means is provided for engaging the cam follower means and opening and closing the finger gripper means. Both the cam means for actuating the swing gripper means and for opening and closing the gripper finger means are mounted on common rotatable shaft means for conjoint rotation to effect oscillation of the swing gripper means in timed relation with the opening and closing of the gripper finger means.

The means for receiving a copy sheet from the first gripper means on the impression cylinder is disclosed as chain gripper means operable from an open position to a closed position for releasably engaging the lead end of the sheet in timed relation with the opening of the first gripper means on the impression cylinder for transferring the lead end of the sheet to the chain gripper means and transporting the sheet away from the impression cylinder. The chain gripper means is actuated to its open position for releasing the lead end of the sheet to permit the swing gripper means to engage the trail end of the sheet. Second chain gripper means is provided for receiving a duplexed sheet from the impression cylinder and transporting the sheet to a discharge station.

Another feature of the invention is the provision of means for selectively adjusting the position of the second gripper means on the impression cylinder, about the periphery of the impression cylinder relative to the first gripper means, to vary the distance between the first and second gripper means to accommodate sheets of different sizes.

Other objects, features and advantages of the invention will be apparent from the following description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 3 is a somewhat schematic view illustrating the clamp means for locking the second gripper means in adjusted position on the impression cylinder;

FIG. 4 is a fragmented section, on an enlarged scale, taken generally along line 4—4 of FIG. 3;

FIG. 5 is a fragmented perspective view, on an enlarged scale, of the second gripper means on the impression cylinder;

FIG. 6 is a fragmented end elevation, partially in section, of the swing gripper means transferring a trail end of a copy sheet to the second gripper means;

DETAILED DESCRIPTION OF THE PREFERRED EMBODIMENT

Figure 1:
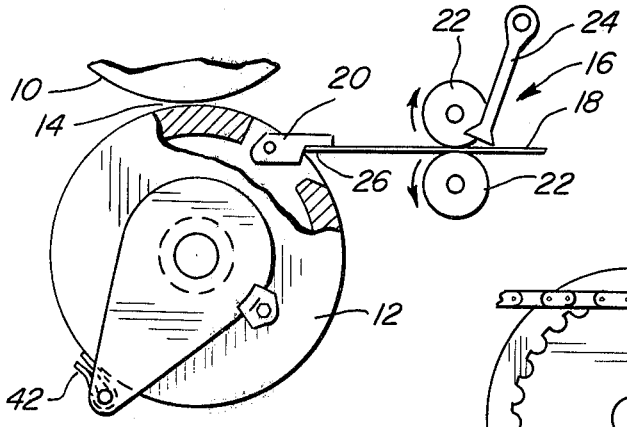
FIG. 1 is a somewhat schematic illustration of a single printing couple in a duplicating machine, showing the lead end of the sheet being fed to first gripper means on an impression cylinder.
Figure 1A:
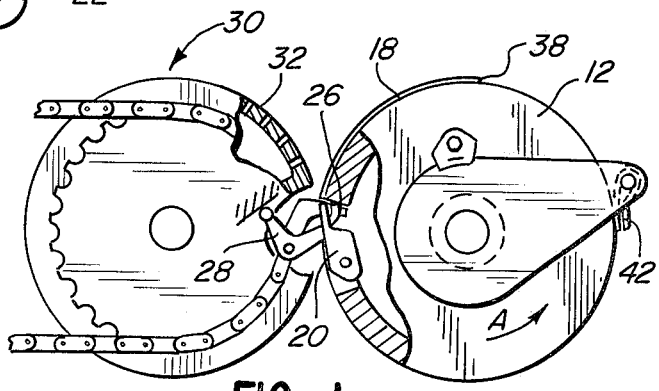
FIG. 1*a* is a somewhat schematic illustration of the impression cylinder transferring the lead end of the sheet to chain gripper means of the present invention.
Figure 1B:
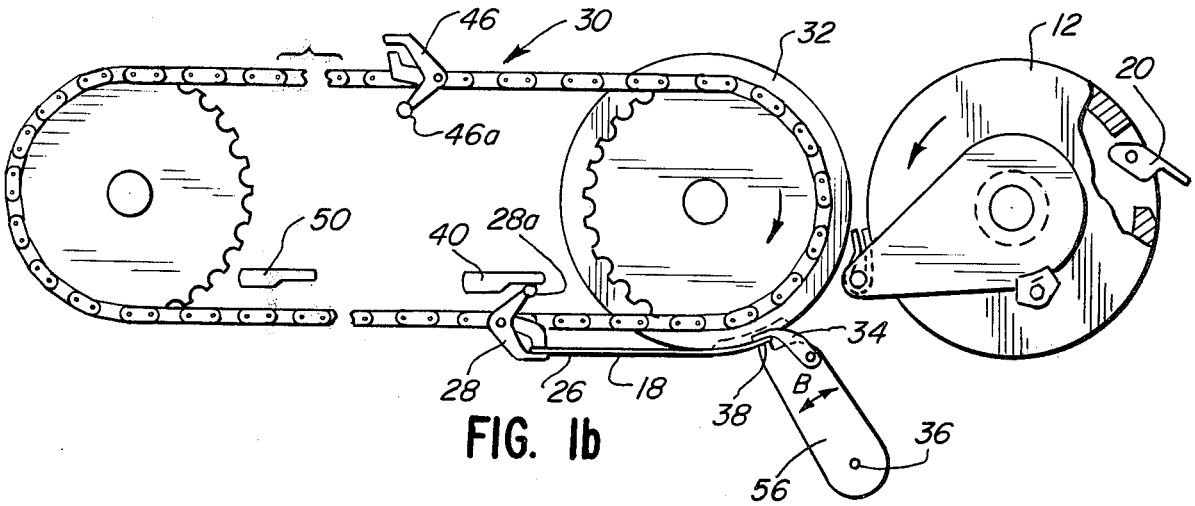
FIG. 1*b* is a somewhat schematic illustration of the swing gripper means of the present invention engaging a trail end of the sheet being transported by the chain gripper means.
Figure 1C:
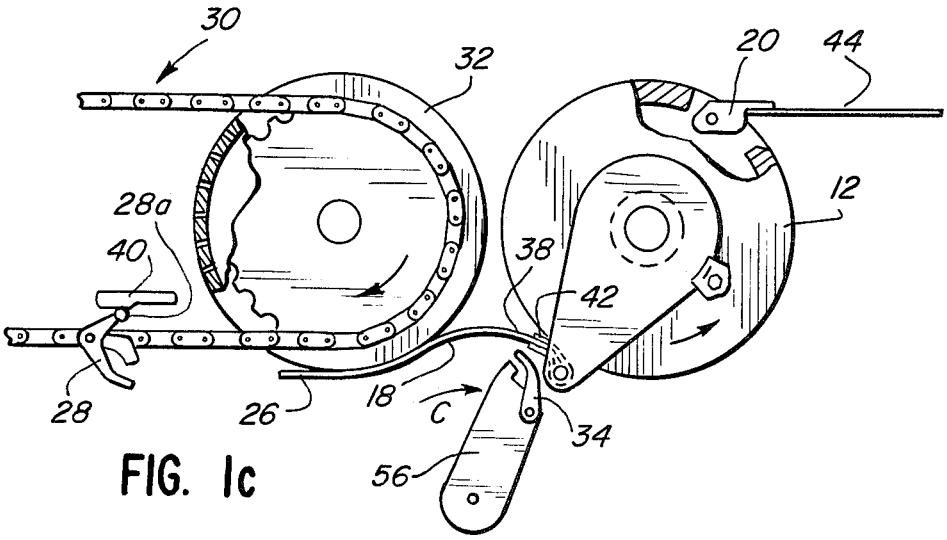
FIG. 1*c* is a somewhat schematic illustration of the swing gripper means re-feeding the trail end of the sheet back to second gripper means on the impression cylinder, with a second copy sheet being fed to the first gripper means.
Figure 1D:
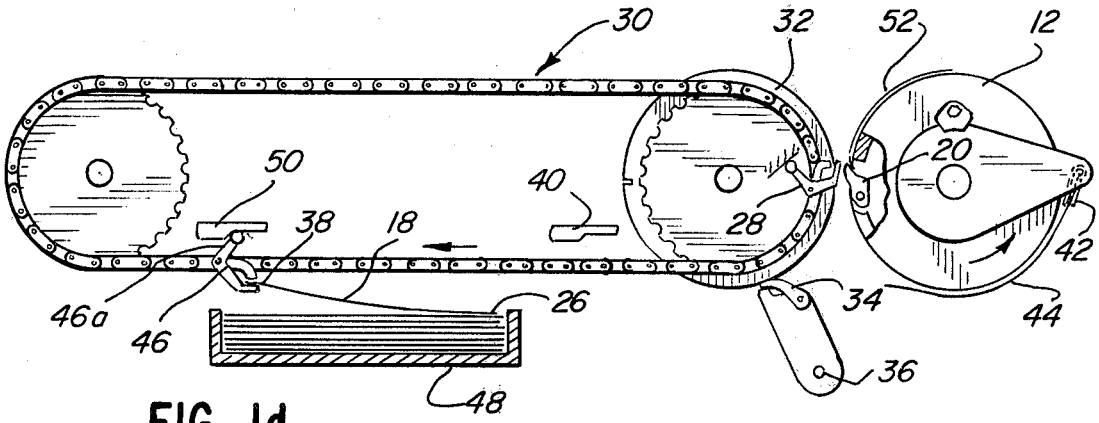
FIG. 1*d* is a somewhat schematic illustration of the second chain gripper means delivering a duplexed sheet to a discharge station, and with the impression cylinder loaded with two copy sheets.

Referring to the drawings in greater detail, FIGS. 1–1*d* illustrate the sequence of operation during duplexing of copy sheets in accordance with the present invention. The invention is designed for use in duplicating machines for duplicating images on both sides of copy sheets, for instance in an offset lithographic duplicating machine, utilizing a single printing couple for imaging both sides of a copy sheet. In general, such machines include a master cylinder (not shown in the drawings) for supporting a master or planographic printing plate provided with first and second image areas. The master is attached to the master cylinder in a conventional manner, and any suitable ink and moisture supply may be utilized in association therewith. Of course, in the case of imaging only one side of copy sheets ("simplexing"), a single image area would be involved. The master cylinder forms a nip with a blanket cylinder so that ink images from the master will be transferred to the blanket cylinder. The blanket cylinder forms a nip with an impression cylinder which carries a sheet through the nip for transferring ink images from the blanket cylinder to the copy sheet.

Referring to FIG. 1, a single printing couple is illustrated to include a blanket cylinder 10 and an impression cylinder 12 forming a nip 14 therebetween. Feeding means, generally designated 16, is provided for advancing a copy sheet 18 to a first gripper means 20 on impression cylinder 12. The feeding means can take the form of conventional apparatus, such as including feed rollers 22 and suction cups 24 for feeding sheets seriatim to impression cylinder 12. In accordance with conventional practice, first gripper means 20 releasably engages a lead end 26 of sheet 18 and rotation of the impression cylinder carries the sheet through nip 14 between the impression cylinder and the blanket cylinder to transfer ink images to the copy sheet.

FIG. 1*a* illustrates impression cylinder 12 having been rotated to bring lead end 26 of sheet 18 into registry to be releasably engaged by a chain gripper means 28 of a chain transport means, generally designated 30. The impression cylinder has been rotated in the direction of arrow A from the position shown in FIG. 1 to the position shown in FIG. 1*a* after sheet 18 has received the first image on the first side of the sheet from blanket cylinder 10. Opening and closing of first gripper means 20 is synchronized with the operation of opening and closing of chain gripper means 28 to transfer lead end 26 of the sheet from the first gripper means to the chain gripper means.

Chain delivery unit 30 transports sheet 18 away from impression cylinder 12 and preferably includes a vacuum drum 32 for holding the sheet taut during transport by chain gripper means 28 to assure accurate registration of the sheet.

Referring to FIG. 1*b*, a swing gripper means 34 is pivotally mounted, as at 36, for oscillatory movement in the direction of double headed arrow B. The swing gripper means is provided for releasably engaging a trail end 38 of sheet 18 in timed relation with release of the sheet by chain gripper means 28 and re-feeding the sheet back to impression cylinder 12. After the sheet exits from the impression cylinder, a stationary cam 40 operates chain gripper means 28 from a closed position to an open position to release lead end 26 of the sheet. The release of the lead end of the sheet is timed with the gripping of trail end 38 of the sheet by swing gripper means 34.

Referring to FIG. 1*c*, swing gripper means 34 is pivotally oscillated in the direction of arrow C to re-feed sheet 18 back to impression cylinder 12, whereat trail end 38 of the sheet is releasably engaged by a second gripper means 42 on the impression cylinder. The impression cylinder then carries sheet 18 through nip 14 with blanket cylinder 10 to transfer a second image to the second side of the sheet. As seen in FIG. 1*c*, as the trail end of sheet 18 is being re-fed back to impression cylinder 12 to be releasably engaged by second gripper means 42, a sequential copy sheet 44 is being fed to first gripper means 20 to continue seriatim duplexing of copy sheets as started with sheet 18 in FIG. 1.

Referring to FIG. 1*d*, following transport of sheet 18 through nip 14 between the impression cylinder and the blanket cylinder by second gripper means 42 to image the second side of the sheet with the second image, trail end 38 of the sheet becomes the lead end and is releasably engaged by a second chain gripper means 46 of chain delivery unit 30. The second chain gripper means transports the sheet to a discharge station defined by a receiving hopper 48. A cam 50, similar to cam 40, actuates second chain gripper means 46 to an open position to release sheet 18 into receiving hopper 48. It can be seen that by this time second copy sheet 44 has been re-fed to the impression cylinder by swing gripper 34 which is shown oscillated back to its first position ready to receive the trail edge of a third copy sheet 52 about to be picked-up by first chain gripper means 28.

In order for cam 40 to trip chain gripper means 28 to release a simplexed sheet for grasping by swing gripper means 34, and for cam 50 to trip chain gripper means 46 to discharge a duplexed sheet into receiving hopper 48, these functions must be effected without cam 40 interferring with and tripping chain gripper means 46. Two methods, neither of which are shown in the drawings, are contemplated for effecting alternate tripping of the chain gripper means 28, 46. One method is to employ a cyclically operable solenoid to pull cam 40 out of the path of the chain gripper means every half-cycle to permit chain gripper means 46 to bypass cam 40 and thereafter be tripped by cam 50. A second method is to provide chain gripper means 28 and 46 with cam followers 28*a* and 46*a*, respectively, which are offset relative to their mutual path of travel. Cams 40 and 50 would be correspondingly offset for engagement by the respective cam followers. The second method would obviate any movable parts, such as the cyclically operable solenoid.

The operation and detailed construction of swing gripper means 34 will be described with reference to FIG. 2. A cam operated drive means, generally designated 54, actuates swing gripper means 34 between a first position shown in full lines (as illustrated in FIG. 1*b*) and a second position shown in phantom (as illustrated in FIG. 1*c*) and for operating the swing gripper means between an open position and a closed position.

Swing gripper means 34 includes a pair of arms 56 (only one shown in the drawing) secured on a rotatable shaft 58 journalled in a pair of side plates 60 (only one shown in the drawing). The arms are secured in spaced relationship by a bar or anvil 62. A rotatable shaft 64 is journalled in arms 56, and a plurality of gripper fingers 66 is spaced along shaft 64 for rotation therewith. A set screw 68 is provided for each gripper finger 66 to adjust the position of the fingers along shaft 64. Each gripper finger 66 includes a flat jaw 70 adapted to coact with a flat surface 72 on anvil 62 when the swing gripper means is in closed position to grip the trail end of a copy sheet therebetween.

Cam operated drive means 54 includes a drive shaft 74 rotatably mounted in side plate 60. Drive cam means, generally designated 76, and a sprocket gear 78 are secured on drive shaft 74 for rotation therewith. Shaft 74 is rotatably driven by a chain 80 trained about sprocket gear 78 and associated with a drive motor (not shown). A second drive cam 82 in the form of a cam disc is secured on drive shaft 74 for rotation therewith. Swing gripper shaft 58 extends outwardly beyond side plate 60, and a follower arm 84 is secured thereto. A follower roller 86 is mounted on follower arm 84 for coacting with and following the peripheral cam profile of drive cam means 76. In response to rotation of drive cam means 76 while acting against follower roller 86, follower arm 84 and shaft 58 are rotatably oscillated in both directions to actuate swing gripper means 34 between the first and the second positions.

Figure 2:
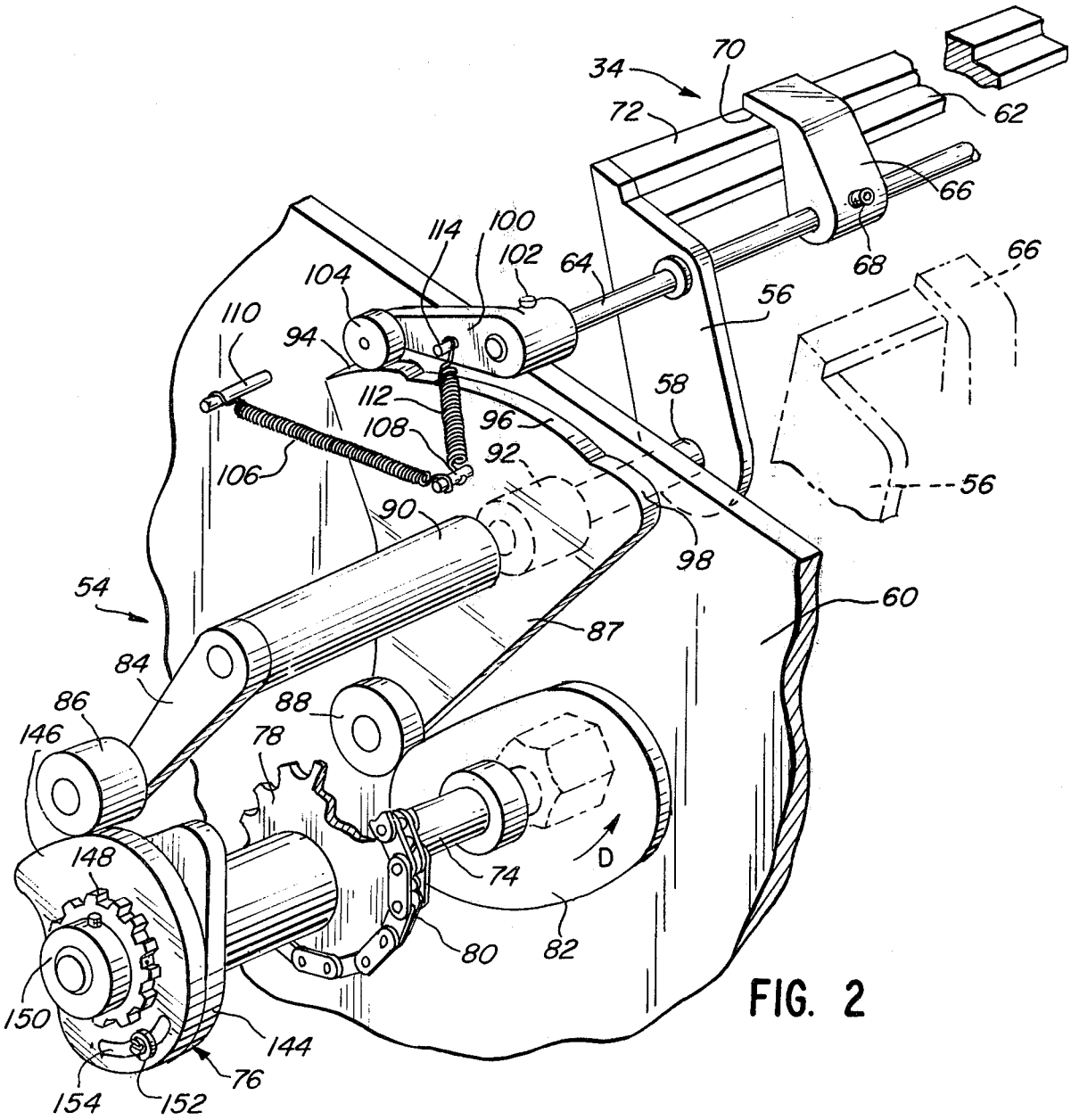
FIG. 2 is a fragmented perspective view of the cam operated drive means for actuating and operating the swing gripper means.

Still referring to FIG. 2, cam operated drive means 54 also controls the opening and closing of swing gripper means 34 for receiving, gripping and releasing the trail ends of the copy sheets. In particular, a cam plate 87 is freely supported on shaft 58 and mounts a follower roller 88 acting against the peripheral cam profile of cam disc 82. Cam plate 87 is held against axial displacement by bearing members 90 and 92 on shaft 58. Cam plate 87 has a cam profile including lobes 94, 96 and 98.

Gripper finger shaft 64 extends outwardly beyond side plate 60 and has a follower arm 100 affixed thereto by a set screw 102. Follower arm 100 carries a follower roller 104 which coacts with the cam profiles of cam plate 87. Cam plate 87 normally is urged in a counterclockwise direction about shaft 58 by a spring 106 extending between a pin 108 on the cam plate and an anchor 110 on side plate 60. Spring 106 urges follower roller 88 against cam disc 82. Similarly, follower roller 104 is urged against cam plate 87 by a spring 112 extending between pin 108 and a pin 114 on follower arm 100.

As cam disc 82 rotates in a counterclockwise direction, as indicated by arrow D, through a portion of a revolution, the lobe on the cam disc acts against follower roller 88 and imparts clockwise motion to cam plate 87 and positions cam profile 94 against follower roller 104 as shown in FIG. 2. Clockwise motion thus is imparted to shaft 64 thereby operating gripper fingers 66 from the closed to the open position for receiving the trail end of a copy sheet when the swing gripper means is in the first position.

As cam disc 82 continues to rotate to impart clockwise rotation to cam plate 87 under the influence of spring 106, recessed cam profile 96 imparts counterclockwise motion to shaft 64 to close gripper fingers 66 to grip the trail end of the sheet. The gripper fingers are maintained in the closed position by cam profile 96 during further movement of cam plate 87 for transport of the sheet from chain gripper means 28 to second gripper means 42 on the impression cylinder.

Further continued rotation of cam disc 82 imparts further clockwise motion to cam plate 87 to position cam profile 98 against follower roller 104. This movement of cam plate 87 thereby again opens the gripper fingers for releasing the trail end of the sheet when swing gripper means 34 is in the second position. By linking drive chain 80 with the chain drive of chain delivery unit 30, gripper fingers 66 are operated in timed relation with the operation of chain gripper means 28, second gripper means 42 on impression cylinder 12 and the movement of swing gripper means 34 between the first and the second position described above. Thus, the gripper fingers are opened when swing gripper means 34 is in the first position for receiving the trail end of a copy sheet carried by chain gripper means 28. The gripper fingers are closed during movement of swing gripper means 34 toward the second position to transport the sheet to second gripper means 42 of the impression roller. The gripper fingers again are opened when swing gripper means 34 is at the second position to release and transfer the trail end of the sheet to second gripper means 42. Continued rotation of cam disc 87 and drive cam means 76 through a complete revolution restores cam plate 87 and swing gripper means 34 to the position shown in FIG. 2, with swing gripper means 34 at the first position and gripper fingers 66 opened in readiness to receive, grip and transport a succeeding copy sheet.

Referring to FIGS. 3 and 4, means is provided for mounting second gripper means 42 on impression cylinder 12 for adjustment about the periphery of the impression cylinder to vary the distance between the first and second gripper means to accommodate copy sheets of different sizes. More particularly, second gripper means 42 is mounted between a pair of support plates 116. The right-hand support plate 116 shown in FIG. 4 is shown at one end of impression cylinder 12 in FIG. 3. It can be seen in FIG. 3 that support plates 116 extend beyond the impression cylinder so that second gripper means 42 is positioned peripherally of the cylinder. The second gripper means is supported on a rod 118 extending between the extreme radially outer portion of the support plates.

With reference FIG. 4, a shaft 120 has a threaded end 122 carrying a nut 124 for engagement by an end 126 of a tool 128. The tool normally is held out of operative position by a coil spring 130. A pair of clamp plates 132 are mounted in apertures 134 in support plates 116 about shaft 120. Each clamp plate 132 has a lip portion 136 which abuts against the outside of the respective support plate 116. Thus, by forcing clamp plates 136 inwardly toward each other, support plates 116 are rigidly fixed. The support plates are held against movement when nut 124 is tightened. Thus, by loosening nut 124 with tool 128, clamp plates 132 release or free support plates 116 for movement to position second gripper means 42 to a desired selected position. Thereafter, nut 124 is tightened and lip portions 136 of clamp plates 132 secure support plates 116 in set position. Tool end 126 is inserted to loosen and tighten nut 24 through an opening 138 in a machine frame wall 140.

FIGS. 5 and 6 illustrate second gripper means 42 to be of conventional construction for operation between open and closed positions by suitable cam means (not shown). The second gripper means is provided with a plurality of notches 142 positioned in spaced relation corresponding to the spacing of gripper fingers 66 to provide clearance for interaction between the gripper fingers and second gripper means 42 during transfer of the trail end of a copy sheet to the second gripper means as best shown in FIG. 6.

Figure 7:
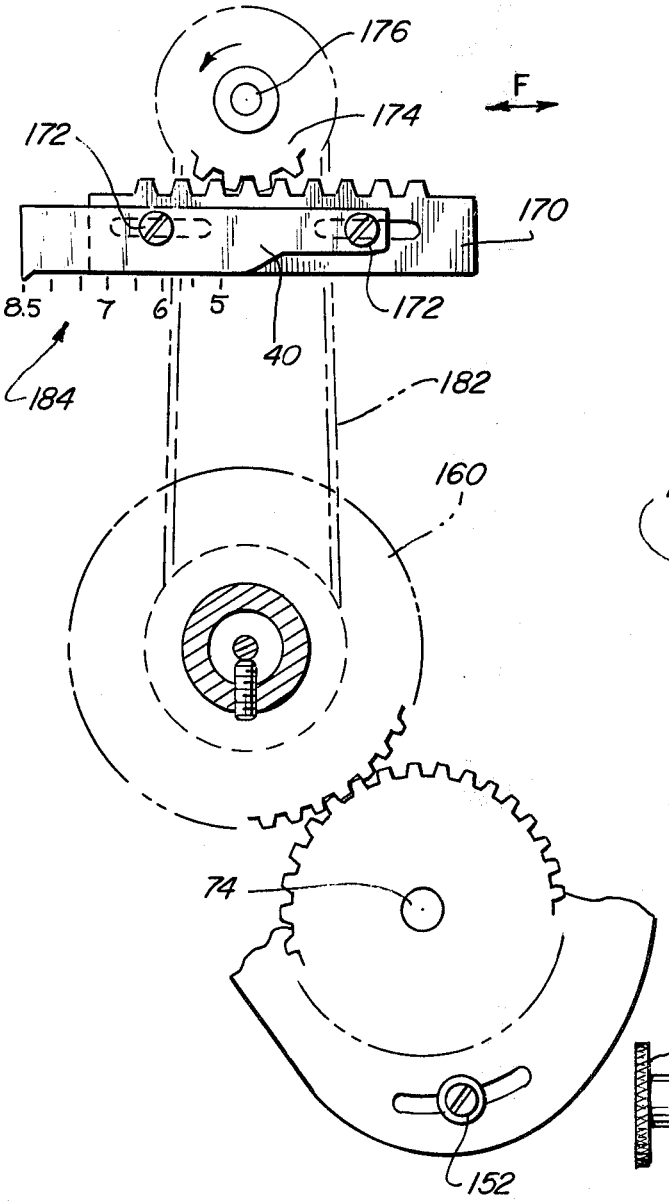
FIG. 7 is a somewhat schematic illustration of the means for adjusting the timing between the swing gripper means and the chain gripper means.
Figure 8:
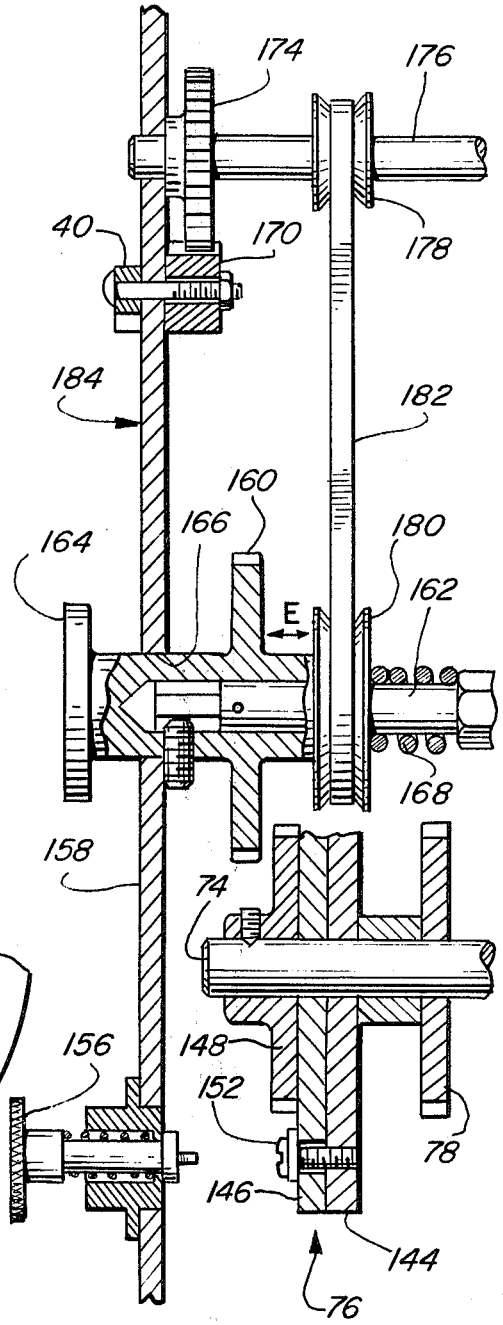
FIG. 8 is and end elevation, partially in section, looking generally to the left in FIG. 7.

Referring to FIGS. 7 and 8 (as well as FIG. 2), means is provided for adjusting the timing of swing gripper means 34 to accommodate copy sheets of different sizes, including means for adjusting the timing of the swing gripper means in relation to the chain gripper means. More particularly, drive cam means 76 includes a first cam plate 144 fixed to shaft 74, a second cam plate 146 rotatable relative to the shaft, and a sprocket gear 148 fixed to second cam plate 146 by a set screw 150 (FIG. 2). Second clamp plate 148 is sandwiched between first cam plate 144 and the sprocket gear. A nut 152 extends through an arcuate slot 154 in second cam plate 146 and is threaded into first cam plate 144. Nut 152 can be loosened and tightened to rotatably adjust second cam plate 146 relative to first cam plate 144 to change the lobes and dwells of drive cam means 76 to thereby adjust the location of the first and second positions of swing gripper means 34. In order to loosen and tighten nut 152, a tool 156 (FIG. 8) is mounted in a machine frame wall 158 for movement through the wall to loosen and tighten nut 152, similarly to tool 128 shown in FIG. 4.

In order to rotate second cam plate 146 relative to first cam plate 144, and with reference to FIG. 8, a sprocket gear 160 is movable axially on a shaft 162 in the direction of double headed arrow E by a manually manipulatable knob 164 extending through an aperture 166 in machine frame wall 158. By pushing knob 164 inwardly (to the right in FIG. 8) sprocket gear 160 will be moved into planar alignment with and in mesh with sprocket gear 148. Manual rotation of knob 164 thus will rotate sprocket gear 148 and adjustably rotate second cam plate 146 relative to first cam plate 144. On release of knob 164, a coil spring 168 will bias the sprocket gears out of meshed engagement. Nut 152 then can be retightened by tool 156 to lock the cam plates in relative position of adjustment.

Adjustment of drive cam means 76, as described above, also simultaneously adjusts cam 40 which opens first chain gripper means 28 to coordinate the timing thereof with the operation of swing gripper means 34. More particularly, cam 40 is shown in FIG. 7 locked to a gear rack 170 by a pair of lock nuts 172. Gear rack 170 is in mesh with a pinion gear 174 fixed to a shaft 176. A first pulley 178 (FIG. 8) is fixed to shaft 176 and a second pulley 180 is fixed to shaft 162, with a drive belt or chain 182 trained about the pulleys. Therefore, as knob 164 is rotated to adjust drive cam means 76, as described above, gear rack 170 also will be moved linearly in the direction of double headed arrow F (FIG. 7) to simultaneously adjust the position of cam 40 which actuates chain gripper means 28. Calibrations, generally designated 184, can be located on the front face of frame wall 158 to visually indicate the extent of adjustment as an operator rotates knob 164. For instance, sheet sizes ranging from 5 to 8.5 inches are illustrated.

From the foregoing, it will be appreciated that the present invention provides a new and improved duplicating apparatus utilizing a single printing couple for imaging both sides of a copy sheet in cyclical operation. The apparatus is fully adjustable and eliminates much of the complex mechanism of prior art devices for handling and re-feeding copy sheets to the printing couple for duplex copying.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a duplicating machine for duplicating images on both sides of copy sheets including a blanket cylinder having first and second images transferable to the copy sheets, an impression cylinder forming a nip with the blanket cylinder and for supporting and transferring the copy sheets through the nip, and means for feeding copy sheets to the impression cylinder, means for handling said sheets for duplexing said images thereon comprising:

first gripper means on said impression cylinder for releasably engaging a lead end of a copy sheet and moving the sheet through said nip to transfer the first image to a first side of the sheet;

transport gripper means for releasably engaging the lead end of the sheet transferred thereto by said first gripper means and transporting the sheet in a direction away from the impression cylinder;

swing gripper means for releasably engaging a trail end of the sheet in timed relation with release of the sheet by said transport gripper means and re-feeding the sheet back to the impression cylinder; and second gripper means on the impression cylinder for releasably engaging said trail end of the sheet and moving the sheet through the nip to transfer the second image to a second side of the sheet.

2. In a duplicating machine as set forth in claim 1, wherein said swing gripper means comprising means oscillatable between a first position for engaging the trail end of the sheet and a second position for releasing the trail end of the sheet and re-feeding the sheet back to the impression cylinder.

3. In a duplicating machine as set forth in claim 2, wherein said swing gripper means is pivotally mounted for oscillatory movement between said positions.

4. In a duplicating machine as set forth in claim 3, including actuating means for pivoting said swing gripper means in timed relation with the release of the lead end of the sheet by the transport gripper means and rotation of the impression cylinder.

5. In a duplicating machine as set forth in claim 4, wherein said actuating means includes cam follower means operatively associated with said swing gripper means, rotatable cam means for engaging the cam follower means and pivoting the swing gripper means between said positions, and means for rotating the cam means.

6. In a duplicating machine as set forth in claim 5, wherein said swing gripper means includes gripper finger means and means for operating the gripper finger means between open and closed positions for releasably engaging the trail end of the sheet, comprising:

cam follower means operatively associated with said gripper finger means, rotatably cam means for engaging the cam follower means and opening and closing the finger gripper means, and means for rotating the cam means.

7. In a duplicating machine as set forth in claim 6, wherein both said cam means for said actuating means and for said gripper finger means are mounted on common rotatable shaft means for conjoint rotation to effect oscillation of said swing gripper means and said gripper finger means in timed relation.

8. In a duplicating machine as set forth in claim 1, including means for selectively adjusting the position of said second gripper means about the periphery of the impression cylinder to vary the distance between the first and second gripper means to accommodate sheets of different sizes.

9. In a duplicating machine as set forth in claim 1, wherein said swing gripper means is pivotally mounted for oscillatory movement between a first position for engaging the trail end of the sheet and a second position for releasing the trail end of the sheet and re-feeding the sheet back to the impression cylinder.

10. In a duplicating machine as set forth in claim 9, including actuating means for pivoting said swing gripper means between said positions in timed relation to the release of the lead end of the sheet by the transport gripper means, and means for adjusting the timing of said actuating means relative to said transport gripper means to accommodate sheets of different sizes.

11. In a duplicating machine as set forth in claim 1, wherein said transport gripper means comprises a continuous belt-like member having the transport gripper means thereon.

12. In a duplicating machine as set forth in claim 11, including second transport gripper means for releasably engaging the trail end of the sheet in timed relation with release of the sheet by the second gripper on the impression cylinder and transporting the sheet to a discharge station.

13. In a duplicating machine for duplicating images on both sides of copy sheets including a blanket cylinder having first and second images transferable to the copy sheets, an impression cylinder forming a nip with the blanket cylinder and for supporting and transferring the copy sheets through the nip, first gripper means operatively associated with the impression cylinder for releasably engaging a lead end of a copy sheet and moving the sheet through said nip to transfer the first image to a first side of the sheet, and second gripper means operatively associated with the impression cylinder for releasably engaging a trail end of the sheet and moving the sheet trail-end-first through the nip to transfer the second image to a second side of the sheet, the improvement comprising means for handling said sheets and for re-feeding the sheets to said second gripper means, said handling and re-feeding means including means for receiving a copy sheet from said first gripper means after the first image is transferred to the sheet, and swing gripper means for releasably engaging the trail end of the sheet and re-feeding the sheet from the receiving means to the second gripper means on the impression cylinder.

14. The improvement of claim 13, wherein said swing gripper means comprising means oscillatable between a first position for engaging the trail end of the sheet and a second position for releasing the trail end of the sheet and re-feeding the sheet back to the impression cylinder.

15. The improvement of claim 14, wherein said swing gripper means is pivotally mounted for oscillatory movement between said positions.

16. The improvement of claim 15, including actuating means for pivoting said swing gripper means, including cam follower means operatively associated with said swing gripper means, rotatable cam means for engaging the cam follower means and pivoting the swing gripper means between said positions, and means for rotating the cam means.

17. The improvement of claim 16, wherein said swing gripper means includes gripper finger means and means for operating the gripper finger means between open and closed positions for releasably engaging the trail end of the sheet, comprising:

cam follower means operatively associated with said gripper finger means, rotatable cam means for engaging the cam follower means and opening and closing the finger gripper means, and means for rotating the cam means.

18. The improvement of claim 17, wherein both said cam means for said actuating means and for said gripper finger means are mounted on common rotatable shaft means for conjoint rotation to effect oscillation of said swing gripper means and opening and closing of said gripper finger means in timed relation.

19. In an offset duplicating machine including a blanket cylinder having a first and a second image transferable to a copy sheet, an impression cylinder for supporting a copy sheet during transfer of the first and the second image to the sheet and means for feeding copy sheets to the impression cylinder, the improvement of a duplexing apparatus comprising:

first gripper means on the impression cylinder operable from an open position to a closed position for releasably engaging a lead end of the sheet to hold the sheet during transfer of the first image to a first side of the sheet;

chain gripper means operable from an open position to a closed position for releasably engaging the lead end of the sheet in timed relation with the opening of the first gripper means for transferring the lead end of the sheet to the chain gripper means and transporting the sheet in a direction away from the impression cylinder;

swing gripper means operable between an open position and a closed position for releasably engaging a trail end of the sheet;

means for operating the chain gripper means to the open position for releasing the lead end of the sheet to permit the swing gripper means to engage the trail end of the sheet;

means for operating the swing gripper means to the closed position for engaging the trail end of the sheet released by the chain gripper means in response to the swing gripper means being in a first position, for actuating the swing gripper means from the first position to a second position for transporting the sheet to a second gripper means associated with the impression cylinder, and for operating the swing gripper means to the open position for releasing the trail end of the sheet for transfer to the second gripper means in response to the swing gripper means being in the second position;

said second gripper means being operable from an open to a closed position for releasably engaging the trail end of the sheet to hold the sheet during transfer of the second image to a second side of the sheet.

20. The apparatus as set forth in claim 19, further comprising:

second chain gripper means operable from an open position to a closed position for releasably engaging the trail end of the sheet in timed relation with the opening of the second gripper means for transferring the trail end of the sheet to the second chain gripper means following imaging of the second side of the sheet and transporting the sheet to a discharge station; and means for operating the second chain gripper means to the open position for releasing the sheet at the discharge station.

21. The apparatus as set forth in claim 19, including means for selectively adjusting the position of said second gripper means about the periphery of the impression cylinder to vary the distance between the first and second gripper means to accommodate sheets of different sizes.

22. The apparatus as set forth in claim 19 wherein said means for actuating the swing gripper means between the first position and the second position comprises:

first rotatable shaft means for supporting the swing gripper means;

cam follower means mounted on the first shaft means;

drive cam means coacting with the cam follower means for imparting rotation to the first shaft means in a first direction in response to rotation of the drive cam means through a portion of a revolution for actuating the swing gripper means from the first position to the second position, and for imparting rotation to the first shaft means in a second direction in response to rotation of the drive cam means through a complete revolution for actuating the swing gripper means from the second position to the first position; and means for rotating the drive cam means.

23. The apparatus as set forth in claim 22 wherein said swing gripper means includes gripper finger means, and the means for operating the swing gripper means between the open position and the closed position comprises:

second rotatable shaft means for supporting the gripper finger means;

cam follower means mounted on the second shaft means;

cam plate means coacting with the cam follower means for imparting rotation to the second shaft means in response to rotation of the cam plate means for operating the gripper finger means between the open position and the closed position;

follower roller means mounted on the cam plate means;

cam disc means mounted on said first rotatable shaft means and coacting with the follower roller means for imparting rotational movement to the cam plate means in response to rotation of the cam disc means; and biasing means normally urging the cam plate means in a direction of rotation to maintain the follower roller means against the cam disc means.

* * * * *